US012121960B1

(12) United States Patent
Wang et al.

(10) Patent No.: US 12,121,960 B1
(45) Date of Patent: Oct. 22, 2024

(54) CASTING DIE AND METHOD OF MITIGATING ENTRAINED AIR IN A CAST ARTICLE

(71) Applicant: GM GLOBAL TECHNOLOGY OPERATIONS LLC, Detroit, MI (US)

(72) Inventors: Qigui Wang, Rochester Hills, MI (US); John S. Agapiou, Rochester Hills, MI (US); Liang Wang, Rochester Hills, MI (US); Paul J. Boone, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 18/640,032

(22) Filed: Apr. 19, 2024

(51) Int. Cl.
*B22D 17/22* (2006.01)

(52) U.S. Cl.
CPC ..... *B22D 17/2272* (2013.01)

(58) Field of Classification Search
CPC ..... B22D 17/22; B22D 17/2272
See application file for complete search history.

(56) References Cited

U.S. PATENT DOCUMENTS

2013/0093282 A1* 4/2013 Wang ..... H02K 15/0012 310/211

* cited by examiner

*Primary Examiner* — Kevin P Kerns
*Assistant Examiner* — Steven S Ha
(74) *Attorney, Agent, or Firm* — Quinn IP Law

(57) ABSTRACT

A casting die includes a first ingate defining a first annular chamber and a second ingate defining a second annular chamber and spaced from the first ingate. The die includes a first end ring gate concentric with the first ingate and defining a first end ring chamber in fluid communication with the first annular chamber, and a second end ring gate concentric with the second ingate and defining a second end ring chamber in fluid communication with the second annular chamber. The die includes runners interconnecting the first and second end ring gates. Each of the runners defines a conductor bar channel in fluid communication with the first and second end ring chambers. The die includes an overflow gate disposed between the first and second ingates, wherein the overflow gate defines an annular overflow chamber in fluid communication with the conductor.

19 Claims, 3 Drawing Sheets

CASTING DIE AND METHOD OF MITIGATING ENTRAINED AIR IN A CAST ARTICLE

INTRODUCTION

The disclosure relates to a casting die and a method of mitigating entrained air in a cast article.

Die casting is a metal casting method that involves pouring molten metal into a mold cavity so that the molten metal solidifies and takes the shape of the mold. This metal forming technique allows for versatility in article size and shape, even for complex shapes defining internal cavities or hollow sections. Therefore, die casting may be useful for forming articles such as components of electric motors.

Electric motors convert electrical energy to mechanical energy through an interaction of magnetic fields and current-carrying conductors and may include an element rotatable about a central axis. The rotatable element, e.g., a rotor, may be coaxial with a static element, e.g., a stator. One type of rotor, a squirrel-cage rotor, may have a cage-like shape and include multiple longitudinal conductor bars disposed between and connected to two end rings.

SUMMARY

A casting die includes a first ingate defining a first annular chamber and a second ingate defining a second annular chamber and spaced apart from the first ingate along a central longitudinal axis. The casting die further includes a first end ring gate concentric with the first ingate and defining a first end ring chamber in fluid communication with the first annular chamber, and a second end ring gate concentric with the second ingate and defining a second end ring chamber in fluid communication with the second annular chamber. The casting die also includes a plurality of runners interconnecting the first end ring gate and the second end ring gate, wherein each of the plurality of runners defines a conductor bar channel in fluid communication with the first end ring chamber and the second end ring chamber. In addition, the casting die includes an overflow gate disposed between the first ingate and the second ingate along the central longitudinal axis, wherein the overflow gate defines an annular overflow chamber in fluid communication with the conductor bar channel of each of the plurality of runners.

In one aspect, the casting die may further include an intake gate defining an intake chamber in fluid communication with the first annular chamber and the second annular chamber.

In another aspect, the intake gate may be bifurcated and may include a first arm connected to the first ingate at a first connection and a second arm connected to the second ingate at a second connection.

In an additional aspect, the first ingate may have a first width at the first connection and a second width that is less than the first width at a point spaced apart from the first connection across the central longitudinal axis.

In a further aspect, the first ingate may include a protrusion spaced apart from the first connection and extending away from the central longitudinal axis.

In one aspect, the plurality of runners may be disposed in a radial configuration about the central longitudinal axis.

In another aspect, the overflow gate may completely encircle the plurality of runners.

In an additional aspect, the overflow gate may include a collection bulb and a vent spaced apart from the collection bulb.

In a further aspect, the casting die may further include a first plurality of flowgates each interconnecting the first ingate and the first end ring gate and spaced apart from one another radially about the central longitudinal axis.

In one aspect, each of the first plurality of flowgates may define a first flowgate channel in fluid communication with the first annular chamber and the first end ring chamber.

In another aspect, the casting die may further include a second plurality of flowgates each interconnecting the second ingate and the second end ring gate and spaced apart from one another radially about the central longitudinal axis.

In an additional aspect, each of the second plurality of flowgates may define a second flowgate channel in fluid communication with the second annular chamber and the second end ring chamber.

In a further aspect, the first ingate may completely encircle the first end ring gate and the second ingate may completely encircle the second end ring gate.

In an additional aspect, the first ingate may partially encircle the first end ring gate and the second ingate may partially encircle the second end ring gate.

In a further aspect, the first ingate may include two dead end nodes spaced apart from each other and the central longitudinal axis.

In one aspect, the first end ring gate may be configured to form a first end ring of a rotor, the second end ring gate may be configured to form a second end ring of the rotor, and the plurality of runners may be configured to form a plurality of conductor bars of the rotor.

In another aspect, a motor vehicle may include a rotor formed by the casting die.

In one embodiment, a casting die includes a first ingate defining a first annular chamber and a second ingate defining a second annular chamber and spaced apart from the first ingate along a central longitudinal axis. The casting die also includes a first end ring gate concentric with the first ingate and defining a first end ring chamber in fluid communication with the first annular chamber, and a second end ring gate concentric with the second ingate and defining a second end ring chamber in fluid communication with the second annular chamber. The casting die further includes a plurality of runners interconnecting the first end ring gate and the second end ring gate, wherein each of the plurality of runners defines a conductor bar channel in fluid communication with the first end ring chamber and the second end ring chamber. In addition, the casting die includes an overflow gate disposed between the first ingate and the second ingate along the central longitudinal axis and surrounding the plurality of runners, wherein the overflow gate defines an annular overflow chamber in fluid communication with the conductor bar channel of each of the plurality of runners. The casting die includes an intake gate defining an intake chamber in fluid communication with the first annular chamber and the second annular chamber, wherein the intake gate is bifurcated and includes a first arm connected to the first ingate, a second arm connected to the second ingate, and a body connected to the first arm and the second arm. The body is L-shaped and includes a first leg extending along a first axis that is substantially perpendicular to the central longitudinal axis and a second leg extending along a second axis that is oblique to the first axis and the central longitudinal axis.

A method of mitigating entrained air in a cast article includes filling a casting die with a metal. The casting die includes a first ingate defining a first annular chamber and a second ingate defining a second annular chamber and spaced apart from the first ingate along a central longitudinal axis. The casting die also includes a first end ring gate concentric with the first ingate and defining a first end ring chamber in fluid communication with the first annular chamber, and a second end ring gate concentric with the second ingate and defining a second end ring chamber in fluid communication with the second annular chamber. The casting die further includes a plurality of runners interconnecting the first end ring gate and the second end ring gate, wherein each of the plurality of runners defines a conductor bar channel in fluid communication with the first end ring chamber and the second end ring chamber. In addition, the casting die includes an overflow gate disposed between the first ingate and the second ingate along the central longitudinal axis, wherein the overflow gate defines an annular overflow chamber in fluid communication with the conductor bar channel of each of the plurality of runners. Filling includes introducing the metal to the first annular chamber and the second annular chamber substantially simultaneously such that the metal has a first ingate velocity at the first end ring gate and a second ingate velocity at the second end ring gate that is substantially equal to the first ingate velocity. The method also includes replacing air in the conductor bar channel of each of the plurality of runners with the metal in a first section of each of the plurality of runners between the first end ring gate and the overflow gate and in a second section of the plurality of runners between the second end ring gate and the overflow gate substantially simultaneously to form the cast article and thereby mitigate entrained air in the first end ring chamber, the second end ring chamber, and the conductor bar channel of each of the plurality of runners.

In one aspect, the method further includes, after replacing air, removing the metal from the annular overflow chamber and the cast article from the casting die.

The above features and advantages, and other features and attendant advantages of this disclosure, will be readily apparent from the following detailed description of illustrative examples and modes for carrying out the present disclosure when taken in connection with the accompanying drawings and the appended claims. Moreover, this disclosure expressly includes combinations and sub-combinations of the elements and features presented above and below.

DETAILED DESCRIPTION

Figure 1:
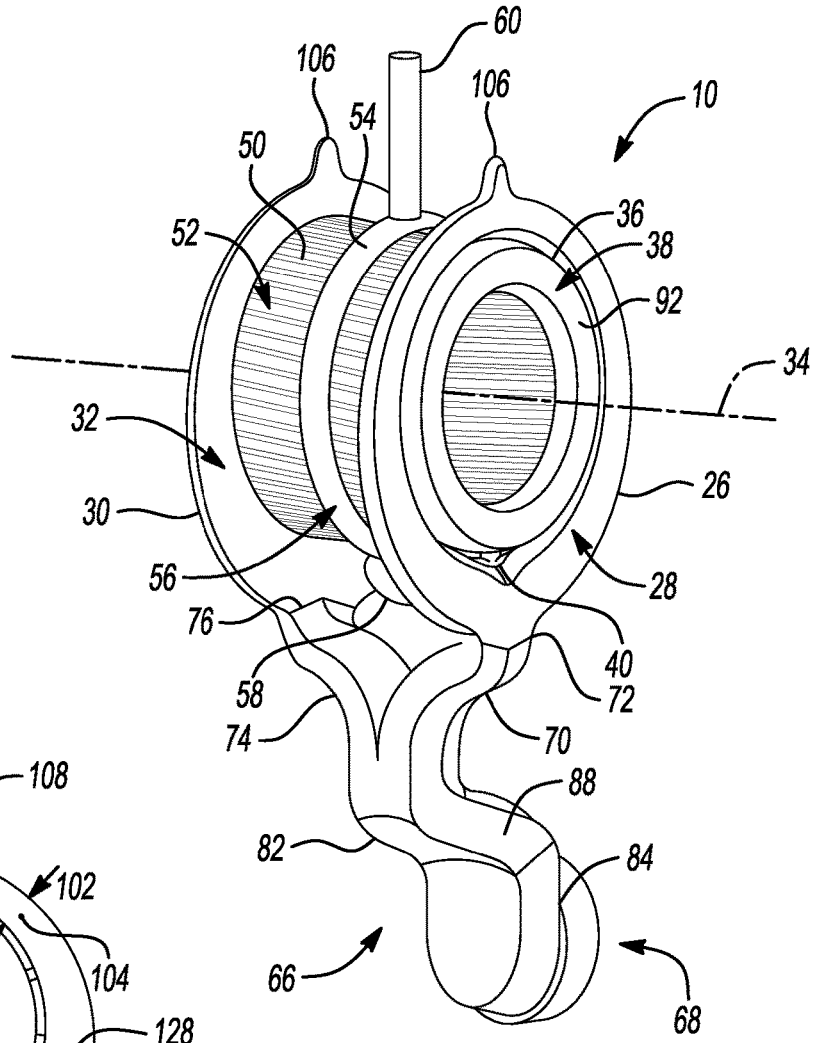
FIG. 1 is a schematic perspective view of a casting die.

Referring to the Figures, wherein like reference numerals refer to like elements, a casting die 10, 110 (FIGS. 1 and 2) and method 12 (FIG. 6) of mitigating entrained air in a cast article 14 (FIG. 5) are shown generally. The casting die 10, 110 and method 12 may be useful for applications requiring lightweight, strong cast articles 14, e.g., a rotor 114 (FIG. 5), having minimal porosity and entrained air after casting and thus enhanced structural integrity and performance. In particular, the method 12 may be useful for reducing a filling distance and increasing metal feeding during casting, as set forth in more detail below.

More specifically, the casting die 10, 110 and method 12 may introduce metal 16 (shown as shading in FIG. 4) to form both end rings 18, 20 (FIG. 5) of the rotor 114 substantially simultaneously while decreasing porosity at all locations of the rotor 114. In particular, the casting die 10, 110 and method 12 may form the rotor 114 by equalizing an ingate velocity at two ends of the casting die 10, 110 as both end rings 18, 20 are cast simultaneously. In addition, the rotor 114 by filling the conductor bars 22 from each end of the casting die 10, 110 towards a middle of the conductor bars 22, as set forth in more detail below. As such, the casting die 10, 110 and method 12 may enable production of cast articles 14 having complex shapes and excellent dimensional accuracy without excess porosity.

Therefore, the casting die 10, 110 and method 12 may be useful for automotive applications such as, but not limited to, prototyping and manufacturing articles 14 such as rotors 114, e.g., squirrel cage rotors, and other vehicle components. For example, a motor vehicle 24 (FIG. 5) may include the rotor 114, such as a squirrel cage rotor for an electric motor, formed by the casting die 10, 110 and method 12. Alternatively, the casting die 10, 110 and method 12 may be useful for non-automotive applications such as, but not limited to, prototyping and manufacturing articles 14 and components for aerospace, aviation, marine, transportation, robot, architectural, and industrial applications.

Referring now to FIG. 1, the casting die 10 includes a first ingate 26 defining a first annular chamber 28. The first ingate 26 may be configured for conveying the metal 16 within the first annular chamber 28 during casting. Similarly, the casting die 10 includes a second ingate 30 defining a second annular chamber 32 and spaced apart from the first ingate 26 along a central longitudinal axis 34. The second ingate 30 may likewise be configured for conveying the metal 16 within the second annular chamber 32 during casting.

Figure 2:
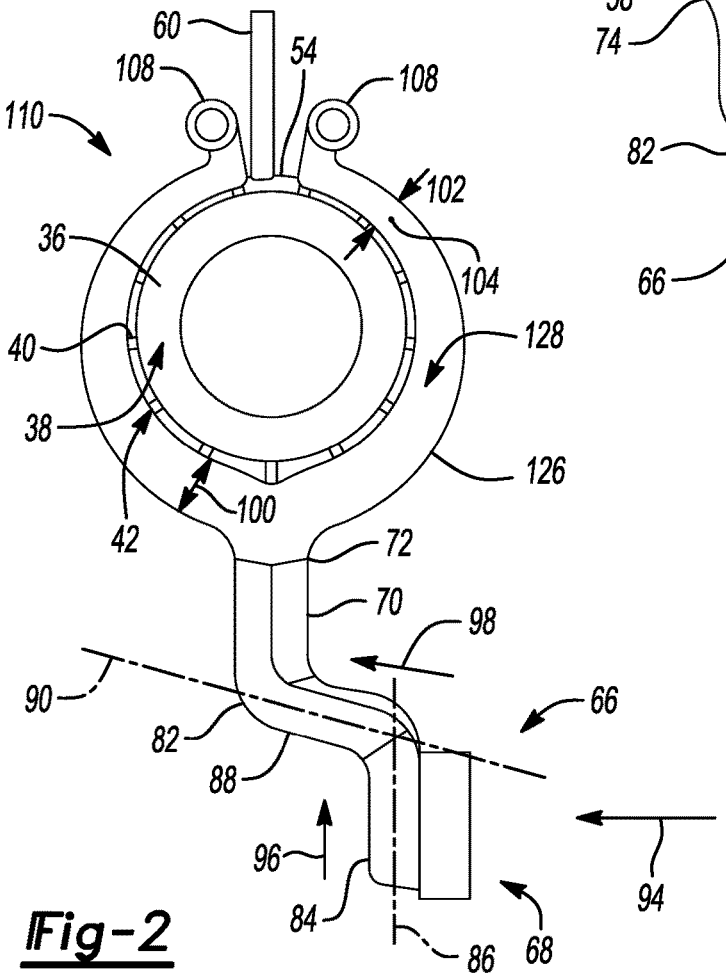
FIG. 2 is a schematic front view of another embodiment of the casting die of FIG. 1.
Figure 3:
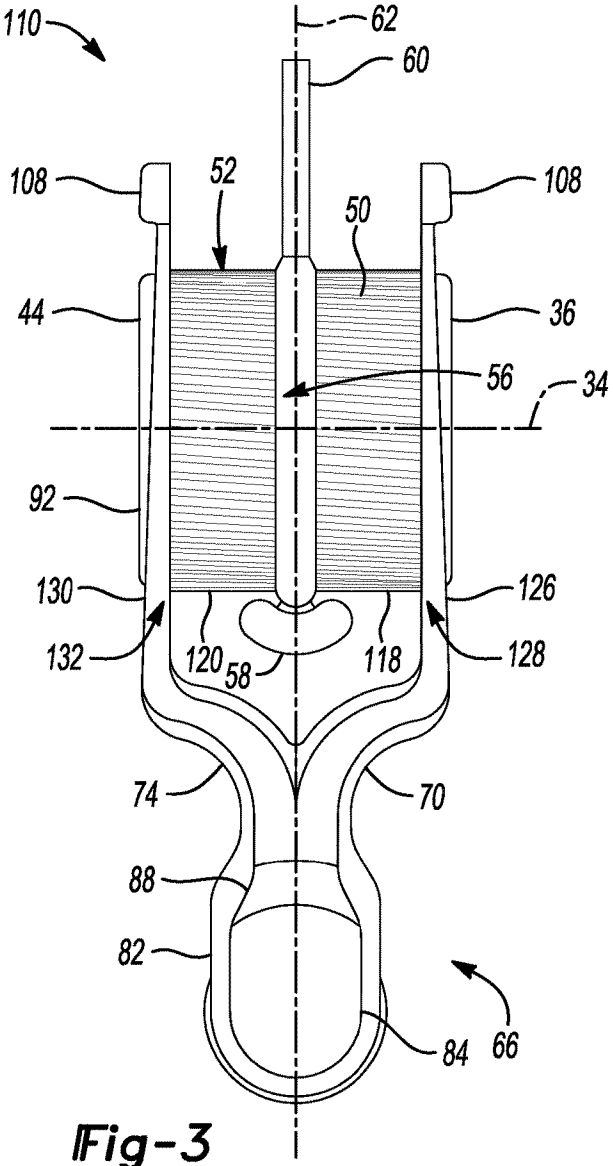
FIG. 3 is a schematic side view of the casting die of FIG. 2.

The casting die 10 also includes a first end ring gate 36 concentric with the first ingate 26 and defining a first end ring chamber 38 in fluid communication with the first annular chamber 28. That is, as shown in FIGS. 1-3, the first end ring gate 36 and first ingate 26, 126 share the same center, i.e., along the central longitudinal axis 34, and the first ingate 26, 126 surrounds the first end ring gate 36. The first annular chamber 28 and the first end ring chamber 38 are fluidly connected so that the metal 16 may flow from the first annular chamber 28 to and through the first end ring chamber 38 during casting, as set forth in more detail below.

More specifically, and as described with reference to FIGS. 1 and 4, the casting die 10 may further include a first plurality of flowgates 40 (FIG. 1) each interconnecting the first ingate 26 and the first end ring 18 and spaced apart from one another radially about the central longitudinal axis 34. That is, the first plurality of flowgates 40 may be spaced apart from one another and may extend radially between the first ingate 26 and the first end ring gate 36 about the central longitudinal axis 34. Further, as best shown in FIG. 2, each of the first plurality of flowgates 40 may define a first flowgate channel 42 in fluid communication with the first annular chamber 28 of the first ingate 26 and the first end ring chamber 38 of the first end ring gate 36. Therefore, during casting, metal 16 may flow from the first annular chamber 28 through the first flowgate channel 42 of each of the first plurality of flowgates 40 to the first end ring chamber 38.

With continued reference to FIGS. 1-4, the casting die 10 further includes a second end ring gate 44 (FIG. 3) concentric with the second ingate 30 and defining a second end ring chamber 46 (FIG. 4) in fluid communication with the second annular chamber 32. That is, the second end ring gate 44 and the second ingate 30 share the same center, i.e., along the central longitudinal axis 34 and the second ingate 30 surrounds the second end ring gate 44. The second annular chamber 32 and the second end ring chamber 46 are fluidly connected so that the metal 16 may flow from the second annular chamber 32 to and through the second end ring chamber 46 during casting, as also set forth in more detail below.

Figure 4:
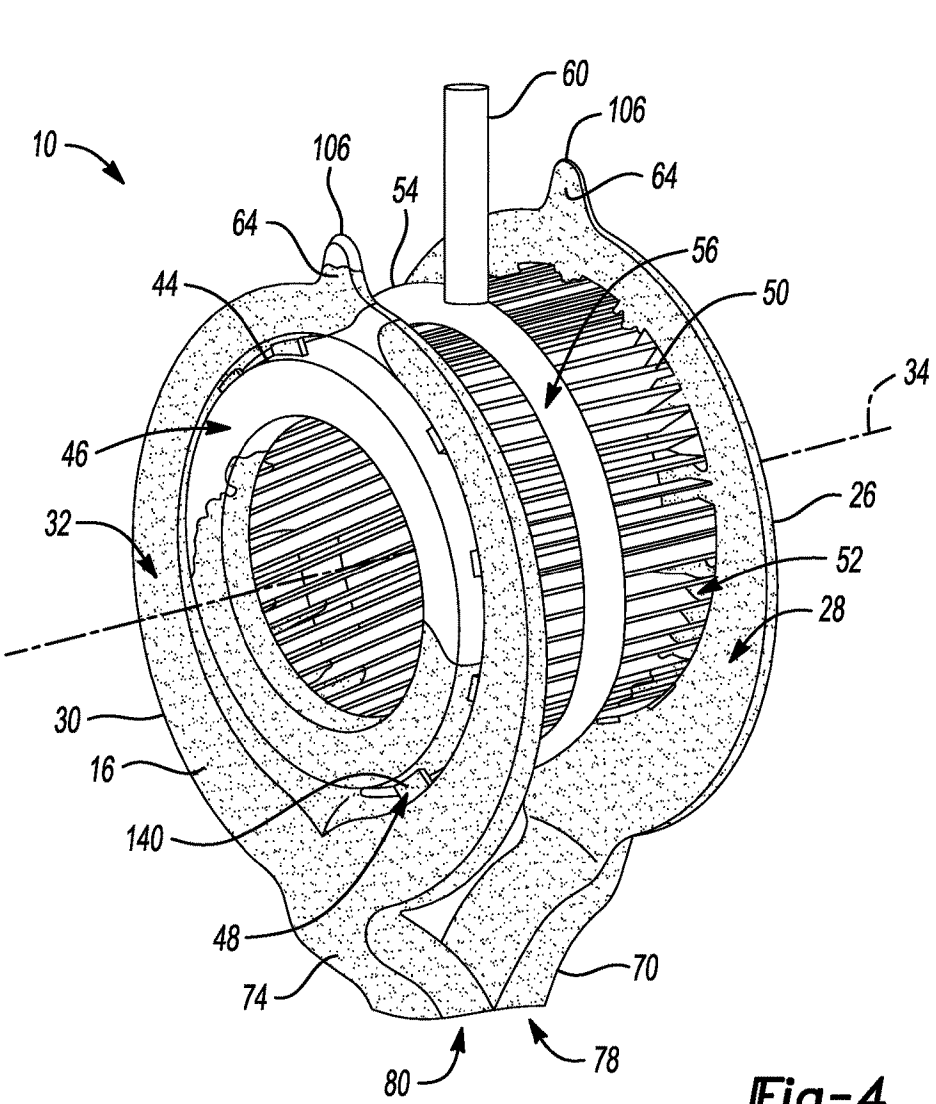
FIG. 4 is a schematic perspective view of the casting die of FIG. 1 filling with a metal.

More specifically, as best shown in FIG. 4, the casting die 10 may further include a second plurality of flowgates 140 each interconnecting the second ingate 30 and the second end ring gate 44 and spaced apart from one another radially about the central longitudinal axis 34. That is, the second plurality of flowgates 140 may be spaced apart from one another and may extend radially between the second ingate 30 and the second end ring gate 44 about the central longitudinal axis 34. Further, each of the second plurality of flowgates 140 may define a second flowgate channel 48 in fluid communication with the second annular chamber 32 of the second ingate 30 and the second end ring chamber 46 of the second end ring gate 44. Therefore, during casting, metal 16 may flow from the second annular chamber 32 through the second flowgate channel 48 of each of the second plurality of flowgates 140 to the second end ring chamber 46.

Referring now to FIGS. 3 and 4, the casting die 10, 110 also includes a plurality of runners 50 interconnecting the first end ring gate 36 and the second end ring gate 44. Each of the plurality of runners 50 defines a conductor bar channel 52 in fluid communication with the first end ring chamber 38 and the second end ring chamber 46. For example, each of the plurality of runners 50 may be shaped as a bar and the conductor bar channel 52 of each of the plurality of runners 50 is fluidly connected to both the first end ring chamber 38 of the first end ring gate 36 and the second end ring chamber 46 of the second end ring gate 44 so that metal 16 may flow from the first and second end ring chambers 38, 46 into the conductor bar channels 52 during casting. As best shown in FIG. 4, the plurality of runners 50 may be disposed in a radial configuration about the central longitudinal axis 34. That is, the plurality of runners 50 may form a cage-like shape about the central longitudinal axis 34.

Figure 5:
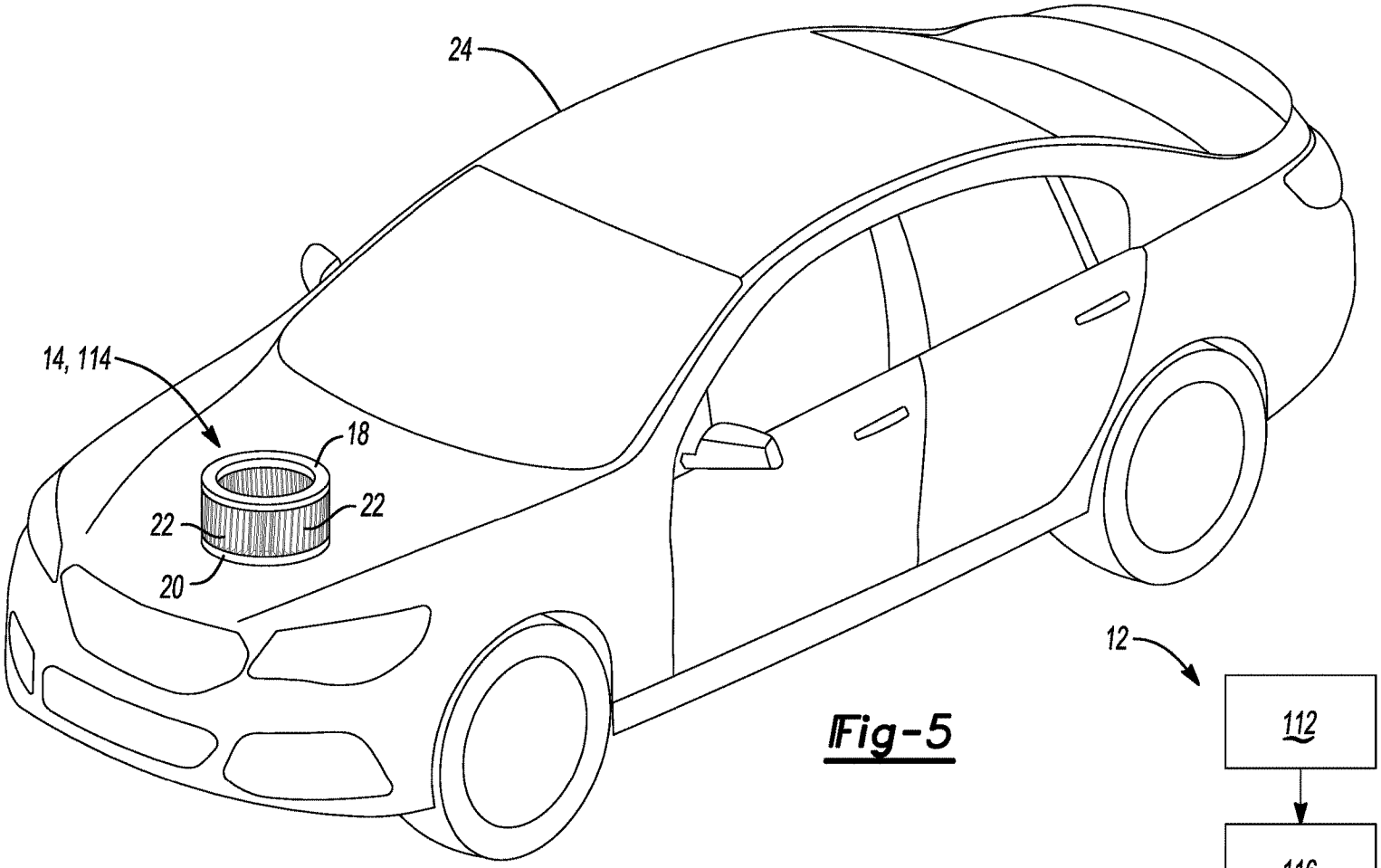
FIG. 5 is a schematic perspective view of a motor vehicle including a rotor formed by the casting die of FIG. 1.

Therefore, referring now to FIG. 5, after casting, the first end ring gate 36 may be configured to form the first end ring 18 of the rotor 114, the second end ring gate 44 may be configured to form the second end ring 20 of the rotor 114, and the plurality of runners 50 may be configured to form the plurality of conductor bars 22 of the rotor 114.

Referring again to FIG. 4, the casting die 10 also includes an overflow gate 54 disposed between the first ingate 26 and the second ingate 30 along the central longitudinal axis 34. The overflow gate 54 defines an annular overflow chamber 56 in fluid communication with the conductor bar channel 52 of each of the plurality of runners 50.

For example, the overflow gate 54 may completely encircle or surround the plurality of runners 50 and may be disposed substantially parallel to the first end ring gate 36 and the second end ring gate 44 along the central longitudinal axis 34. In one non-limiting example, the overflow gate 54 may be disposed about halfway between the first end ring gate 36 and the second end ring gate 44 along the central longitudinal axis 34 and may be fluidly connected to each of the plurality of runners 50 so that metal 16 may flow from the conductor bar channel 52 of each of the plurality of runners 50 to the annular overflow chamber 56 during casting.

As best shown in FIGS. 1 and 3, the overflow gate 54 (FIG. 1) may include a collection bulb 58 and a vent 60 spaced apart from the collection bulb 58. The collection bulb 58 and vent 60 may be spaced apart from one another along an axis 62 that is substantially perpendicular to the central longitudinal axis 34 of the casting die 10, 110. As such, the collection bulb 58 may be configured for collecting excess or dirty metal 64 (FIG. 4), e.g., metal 64 that includes air or other contaminants, that overflows the conductor bar channels 52 during casting. For example, excess or dirty metal 64 may spill over into the collection bulb 58 due to gravity.

After casting, as set forth in more detail below, the excess or dirty metal 64 may be removed from the overflow chamber 56 via the vent 60. For example, a vacuum source (not shown) may be connected to the vent 60 to remove the excess or dirty metal 64.

Referring now to FIGS. 1 and 2, the casting die 10, 110 further includes an intake gate 66 defining an intake chamber 68 in fluid communication with the first annular chamber 28 and the second annular chamber 32. The intake gate 66 may be configured for accepting the metal 16 for casting. That is, molten or otherwise flowable metal 16 may be introduced or fed to the casting die 10, 110 via the intake gate 66 with, for instance, a pump, a ladle, a pipe, or other conveyance mechanism such that the metal 16 may flow from the intake chamber 68 of the intake gate 66 to the first annular chamber 28 and the second annular chamber 32.

More specifically, as best shown in FIG. 1, the intake gate 66 may be bifurcated and may include a first arm 70 connected to the first ingate 26 at a first connection 72 and a second arm 74 connected to the second ingate 30 at a second connection 76. That is, the intake gate 66 may be forked or divided into the first arm 70 and the second arm 74 so that the first ingate 26 and the second ingate 30 may be fed with metal 16 substantially simultaneously during casting. The first arm 70 and the second arm 74 may be hollow and define a first conduit 78 (FIG. 4) and a second conduit 80 (FIG. 4), respectively. The first conduit 78 may be in fluid communication with the first annular chamber 28 and the second conduit 80 may be in fluid communication with the second annular chamber 32 so that metal 16 may flow to both the first end ring gate 36 and the second end ring gate 44 at the same time during casting.

As described with reference to FIG. 2, the intake gate 66 may further include a body 82 connected to the first arm 70 and the second arm 74. The body 82 may be generally L-shaped and may include a first leg 84 extending along a first axis 86 that is substantially perpendicular to the central longitudinal axis 34 and a second leg 88 extending along a second axis 90 that is oblique to the first axis 86 and the central longitudinal axis 34. That is, the body 82 may jog such that, during casting, metal 16 may flow along a plane substantially parallel to an outer surface 92 (FIGS. 1 and 3) of each of the first and second end ring gates 36, 44 (FIG. 3) in a first direction (denoted by first arrow 94 in FIG. 2). The metal 16 may then travel in a second direction (denoted by second arrow 96 in FIG. 2) that is substantially perpendicular to the first direction 94, and may continue within the L-shaped body 82 in a third direction (denoted by third arrow 98 in FIG. 2) in the second conduit 80 of the second leg 88 toward the first arm 70 and second arm 74. Therefore, a single filling or introduction point for the metal 16 may feed both the first ingate 26 and the second ingate 30, and the first end ring gate 36 and second end ring gate 44 accordingly.

As best shown in FIG. 2, the first ingate 26, 126 may have a first width 100 at the first connection 72 and a second width 102 that is less than the first width 100 at a point 104 spaced apart from the first connection 72 across the central longitudinal axis 34. That is, the first ingate 26, 126 may be thicker in one portion than in another portion across the central longitudinal axis 34 so as to optimize metal flow during casting.

In one embodiment of the casting die 10 described with reference to FIGS. 1 and 4, the first ingate 26 may completely encircle the first end ring gate 36, and the second ingate 30 may completely encircle the second end ring gate 44 (FIG. 4). That is, each of the first annular chamber 28 and the second annular chamber 32 may be uninterrupted such that metal 16 may flow around an entirety of the first end ring gate 36 and second end ring gate 44, respectively.

For this embodiment, the first ingate 26 may include a protrusion 106 spaced apart from the first connection 72 of the first arm 70—first ingate 26 and extending away from the central longitudinal axis 34. Likewise, the second ingate 30 may include another protrusion 106 spaced apart from the second connection 76 of the second arm 74—second ingate 30 and extending away from the central longitudinal axis 34. As such, similar to the collection bulb 58 of the overflow gate 54 described above, the protrusion 106 may be configured for collecting excess or dirty metal 64, e.g., metal 64 that includes air or other contaminants, that overflows the first ingate 26 and/or second ingate 30 during casting. For example, excess or dirty metal 64 may spill over into the protrusion 106 under pressure.

In another embodiment of the casting die 110 described with reference to FIG. 2, the first ingate 126 may partially encircle the first end ring gate 36, and a second ingate 130 may partially encircle the second end ring gate 44. That is, each of a first annular chamber 128 and a second annular chamber 132 may be interrupted such that metal 16 may flow around less than an entirety of the first end ring gate 36 and second end ring gate 44, respectively.

For this embodiment, as best shown in FIG. 3, the first ingate 126 may include two dead end nodes 108 spaced apart from each other and the central longitudinal axis 34. Likewise, the second ingate 130 may include another two dead end nodes 108 spaced apart from each other and the central longitudinal axis 34. As such, similar to the collection bulb 58 of the overflow gate 54 described above, the dead end nodes 108 may be configured for collecting excess or dirty metal 64, e.g., metal 64 that includes air or other contaminants, that overflows the first ingate 26 and/or second ingate 30 during casting. For example, excess or dirty metal 64 may spill over into the dead end nodes 108 under pressure.

Figure 6:
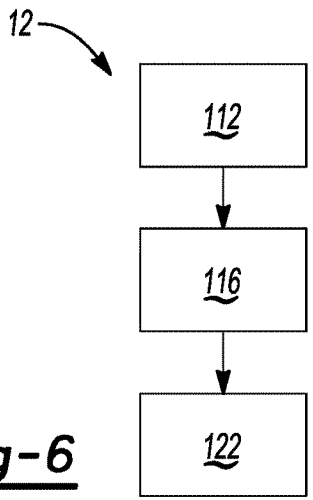
FIG. 6 is a schematic flow diagram of a method of mitigating entrained air in a cast article.

Referring now to FIG. 6, the method 12 of mitigating entrained air in the cast article 14 includes filling 112 the casting die 10, 110 with the metal 16. Filling 112 includes introducing the metal 16 to the first annular chamber 28 and the second annular chamber 32 substantially simultaneously such that the metal 16 has a first ingate velocity at the first end ring gate 36 and a second ingate velocity at the second end ring gate 44 that is substantially equal to the first ingate velocity. That is, filling 112 may include feeding the metal 16 to the first end ring gate 36 and the second end ring gate 44 at substantially the same time so that the metal 16 is pushed at equal rates and quantities from each respective end ring gate 36, 44, through the conductor bar channel 52 of each of the plurality of runners 50, and to the annular overflow chamber 56 of the overflow gate 54.

The method 12 also includes replacing 116 air in the conductor bar channel 52 of each of the plurality of runners 50 with the metal 16 in a first section 118 (FIG. 3) of each of the plurality of runners 50 between the first end ring gate 36 and the overflow gate 54 and in a second section 120 (FIG. 3) of the plurality of runners 50 between the second end ring gate 44 and the overflow gate 54 substantially simultaneously to form the cast article 14 and thereby mitigate entrained air in the first end ring chamber 38, the second end ring chamber 46, and the conductor bar channel 52 of each of the plurality of runners 50. That is, replacing 116 air may include squeezing any air present in the various chambers 28, 32, 38, 46, 56 and channels 42, 48, 52 out of the casting die 10, 110, e.g., via the vent 60, or into the collection bulb 58, protrusion 106, or dead end nodes 108, as the metal 16 flows through the casting die 10.

The method 12 may also include, after replacing 116 air, removing 122 the metal from the annular overflow chamber 56 and the cast article 14 from the casting die 10, 110. That is, removing 122 may include collecting the excess or dirty metal 64, which may include some entrained air, and venting the spent or excess or dirty metal 64 from the annular overflow chamber 56. Removing 122 may also include unpacking the formed cast article 14 from the casting die 10, 110. The cast article 14 may then undergo finishing operations such as sanding or polishing.

Advantageously, the casting die 10, 110 and method 12 mitigate entrained air in the cast article 14. That is, since metal 16 may flow at a substantially equal ingate velocity in both the first end ring gate 36 and the second end ring gate 44 due to the bifurcated design of the body 82, the casting die 10, 110 improves and controls metal feeding such that the cast article 14 has reduced or minimized porosity and excellent strength, structural integrity, and dimensional stability. The casting die 10, 110 and method 12 allow for reduced metal feeding distances and optimized forming of the first end ring 18 and the second end ring 20 of a cast rotor 114 by casting each end ring 18, 20 substantially simultaneously. Further, each conductor bar 22 of the cast rotor 114 may have reduced or minimized porosity since metal 16 flows along half of a length of the conductor bar before reaching the overflow gate 54. Therefore, the casting die 10, 110 and method 12 may reduce scrap rates and optimize casting processes and may be capable of producing strong, lightweight articles 14 with high dimensional accuracy, all without additional tool investment.

The described embodiments of the present disclosure are intended to serve as non-limiting examples, and other embodiments may take various and alternative forms. In addition, the appended drawings are not necessarily to scale, and may present a somewhat simplified representation of various features of the present disclosure, including, for example, specific dimensions, orientations, locations, and shapes. Details associated with such features will be determined in part by the intended application and use environment of the described embodiments.

For purposes of the present description, unless specifically disclaimed, use of the singular includes the plural and vice versa, the terms "and" and "or" shall be both conjunctive and disjunctive, and the words "including", "containing", "comprising", "having", and the like shall mean "including without limitation". Moreover, words of approximation such as "about", "almost", "substantially", "generally", "approximately", etc., may be used herein in the sense of "at, near, or nearly at", or "within 0-5% of", or "within acceptable manufacturing tolerances", or logical combinations thereof. As used herein, a component that is "configured to" perform a specified function is capable of performing the specified function without alteration, rather than merely having potential to perform the specified function after further modification. In other words, the described hardware, when expressly configured to perform the specified function, is specifically selected, created, implemented, utilized, programmed, and/or designed for the purpose of performing the specified function. In addition, the use of ordinals such as first, second and third does not necessarily imply a ranked sense of order, but rather may only distinguish between multiple instances of an act or structure.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims. Moreover, this disclosure expressly includes combinations and sub-combinations of the elements and features presented above and below.

What is claimed is:

1. A casting die comprising:

a first ingate defining a first annular chamber;

a second ingate defining a second annular chamber and spaced apart from the first ingate along a central longitudinal axis;

a first end ring gate concentric with the first ingate and defining a first end ring chamber in fluid communication with the first annular chamber;

a second end ring gate concentric with the second ingate and defining a second end ring chamber in fluid communication with the second annular chamber;

a plurality of runners interconnecting the first end ring gate and the second end ring gate, wherein each of the plurality of runners defines a conductor bar channel in fluid communication with the first end ring chamber and the second end ring chamber; and an overflow gate disposed between the first ingate and the second ingate along the central longitudinal axis, wherein the overflow gate defines an annular overflow chamber in fluid communication with the conductor bar channel of each of the plurality of runners.

2. The casting die of claim 1, further including an intake gate defining an intake chamber in fluid communication with the first annular chamber and the second annular chamber.

3. The casting die of claim 2, wherein the intake gate is bifurcated and includes a first arm connected to the first ingate at a first connection and a second arm connected to the second ingate at a second connection.

4. The casting die of claim 3, wherein the first ingate has a first width at the first connection and a second width that is less than the first width at a point spaced apart from the first connection across the central longitudinal axis.

5. The casting die of claim 3, wherein the first ingate includes a protrusion spaced apart from the first connection and extending away from the central longitudinal axis.

6. The casting die of claim 1, wherein the plurality of runners are disposed in a radial configuration about the central longitudinal axis.

7. The casting die of claim 6, wherein the overflow gate completely encircles the plurality of runners.

8. The casting die of claim 1, wherein the overflow gate includes a collection bulb and a vent spaced apart from the collection bulb.

9. The casting die of claim 1, further including a first plurality of flowgates each interconnecting the first ingate and the first end ring gate and spaced apart from one another radially about the central longitudinal axis.

10. The casting die of claim 9, wherein each of the first plurality of flowgates defines a first flowgate channel in fluid communication with the first annular chamber and the first end ring chamber.

11. The casting die of claim 10, further including a second plurality of flowgates each interconnecting the second ingate and the second end ring gate and spaced apart from one another radially about the central longitudinal axis.

12. The casting die of claim 11, wherein each of the second plurality of flowgates defines a second flowgate channel in fluid communication with the second annular chamber and the second end ring chamber.

13. The casting die of claim 1, wherein the first ingate completely encircles the first end ring gate and the second ingate completely encircles the second end ring gate.

14. The casting die of claim 1, wherein the first ingate partially encircles the first end ring gate and the second ingate partially encircles the second end ring gate.

15. The casting die of claim 14, wherein the first ingate includes two dead end nodes spaced apart from each other and the central longitudinal axis.

16. The casting die of claim 1, wherein the first end ring gate is configured to form a first end ring of a rotor, the second end ring gate is configured to form a second end ring of the rotor, and the plurality of runners are configured to form a plurality of conductor bars of the rotor.

17. A casting die comprising:

a first ingate defining a first annular chamber;

a second ingate defining a second annular chamber and spaced apart from the first ingate along a central longitudinal axis;

a first end ring gate concentric with the first ingate and defining a first end ring chamber in fluid communication with the first annular chamber;

a second end ring gate concentric with the second ingate and defining a second end ring chamber in fluid communication with the second annular chamber;

a plurality of runners interconnecting the first end ring gate and the second end ring gate, wherein each of the plurality of runners defines a conductor bar channel in fluid communication with the first end ring chamber and the second end ring chamber;

an overflow gate disposed between the first ingate and the second ingate along the central longitudinal axis and surrounding the plurality of runners, wherein the overflow gate defines an annular overflow chamber in fluid communication with the conductor bar channel of each of the plurality of runners; and an intake gate defining an intake chamber in fluid communication with the first annular chamber and the second annular chamber;

wherein the intake gate is bifurcated and includes a first arm connected to the first ingate, a second arm connected to the second ingate, and a body connected to the first arm and the second arm;

wherein the body is L-shaped and includes a first leg extending along a first axis that is substantially perpendicular to the central longitudinal axis and a second leg extending along a second axis that is oblique to the first axis and the central longitudinal axis.

18. A method of mitigating entrained air in a cast article, the method comprising:

filling a casting die with a metal, wherein the casting die includes:

a first ingate defining a first annular chamber;

a second ingate defining a second annular chamber and spaced apart from the first ingate along a central longitudinal axis;

a first end ring gate concentric with the first ingate and defining a first end ring chamber in fluid communication with the first annular chamber;

a second end ring gate concentric with the second ingate and defining a second end ring chamber in fluid communication with the second annular chamber;

a plurality of runners interconnecting the first end ring gate and the second end ring gate, wherein each of the plurality of runners defines a conductor bar channel in fluid communication with the first end ring chamber and the second end ring chamber; and an overflow gate disposed between the first ingate and the second ingate along the central longitudinal axis, wherein the overflow gate defines an annular overflow chamber in fluid communication with the conductor bar channel of each of the plurality of runners;

wherein filling includes introducing the metal to the first annular chamber and the second annular chamber substantially simultaneously such that the metal has a first ingate velocity at the first end ring gate and a second ingate velocity at the second end ring gate that is substantially equal to the first ingate velocity; and replacing air in the conductor bar channel of each of the plurality of runners with the metal in a first section of each of the plurality of runners between the first end ring gate and the overflow gate and in a second section of the plurality of runners between the second end ring gate and the overflow gate substantially simultaneously to form the cast article and thereby mitigate entrained air in the first end ring chamber, the second end ring chamber, and the conductor bar channel of each of the plurality of runners.

19. The method of claim 18, further including, after replacing air, removing the metal from the annular overflow chamber and the cast article from the casting die.

* * * * *